US007094132B2

(12) United States Patent
Kremen

(10) Patent No.: US 7,094,132 B2
(45) Date of Patent: Aug. 22, 2006

(54) METHOD OF AND APPARATUS FOR MAGNETIC-ABRASIVE MACHINING OF WAFERS

(75) Inventor: Gennady Kremen, Brooklyn, NY (US)

(73) Assignee: Magnetic Abrasive Technologies, Inc., Rancho Cordova, CA (US)

( * ) Notice: Subject to any disclaimer, the term of this patent is extended or adjusted under 35 U.S.C. 154(b) by 12 days.

(21) Appl. No.: 10/875,911

(22) Filed: Jun. 24, 2004

(65) Prior Publication Data

US 2006/0052039 A1 Mar. 9, 2006

(51) Int. Cl.
*B24B 1/00* (2006.01)

(52) U.S. Cl. ..... 451/36; 451/41; 451/63; 451/103

(58) Field of Classification Search ..... 451/36, 451/37, 103, 104, 113, 41, 59, 63
See application file for complete search history.

(56) References Cited

U.S. PATENT DOCUMENTS 4,169,713 A * 10/1979 Chachin et al. ..... 451/113
4,186,528 A * 2/1980 Yascheritsyn et al. ..... 451/324
4,211,041 A * 7/1980 Sakulevich et al. ..... 451/287
4,306,386 A * 12/1981 Sakulevich et al. ..... 451/36
4,601,431 A * 7/1986 Watanabe et al. ..... 241/172
4,821,466 A * 4/1989 Kato et al. ..... 451/36
5,401,206 A * 3/1995 Majors ..... 451/326
5,419,735 A * 5/1995 Imahashi et al. ..... 451/113
5,577,948 A * 11/1996 Kordonsky et al. ..... 451/35
5,616,066 A * 4/1997 Jacobs et al. ..... 451/36
5,855,735 A * 1/1999 Takada et al. ..... 438/691
6,036,580 A * 3/2000 Igelshteyn et al. ..... 451/36

* cited by examiner

*Primary Examiner*—Eileen P. Morgan
(74) *Attorney, Agent, or Firm*—I. Zborovsky

(57) ABSTRACT

A method of magnetic-abrasive machining of parts has the steps of supporting a part, generating a magnetic field by magnetic means located at one side of the part, placing a magnetic-abrasive powder on a surface located at another, opposite side of the part, so that the magnetic-abrasive powder is attracted by the magnetic means and pressed to the surface of the part, and providing a relative movement of the parts and the magnetic abrasive powder retained by the magnetic means relative to one another so as to machine the surface of the part which is therefore open for observation and supply of the magnetic abrasive powder; and an apparatus is proposed as well.

18 Claims, 6 Drawing Sheets

METHOD OF AND APPARATUS FOR MAGNETIC-ABRASIVE MACHINING OF WAFERS

BACKGROUND OF THE INVENTION

The present invention relates to a method of and apparatus for abrasive machining of parts, for example of wafers.

Semiconductor circuit manufacturers require two qualities of crystalline silicon wafers: "prime" and "test". Prime quality wafers are used in construction of semiconductors products, while test quality wafers are used to pre-qualify manufacturing processes. Further, two types of test wafers exist: prime test wafers with higher quality and reclaim-test wafers with standard quality. For example a candidate reclaim-test or simply "reclaim" wafer may consist of a silicon substrate with semiconductor components implanted and/or diffused into one wafer surface. Reclaiming than involves removing the layers and portions of the underlying silicon, which have been implanted or diffused.

Machining is a part of the wafer manufacture or "wafering". Both general and specific machining processes are used for prime, prime-test and reclaim wafers. The objective of prime and reclaim wafering is to remove as little silicon as possible, while producing as little (SSD) subsurface damage) as possible. The amount of SSD directly corresponds to the time and amount of stock removal of silicon in a chemical-mechanical polishing "CMP" operation. CMP is the most expensive process of all the operations in wafer manufacturing. The less silicon removed (by lapping/etching/polishing or chemical stripping) the more times a customer can reclaim the same wafer and re-use it. Chemical stripping is the most hazardous operation in the reclaim wafering.

During machining of prime wafers a substantial layer of silicon is removed since it is necessary to obtain parallel location of its sides which is equal or less than one micron. After slicing, the non-parallelism is substantial and therefore a lapping process is utilized which provides the parallelism within given limits by removal of a substantial layer of silicon. CMP (polishing) removes then a significant layer of silicon since the subsurface damage reaches a high value after the lapping process. Here there is a contradiction since CMP itself can provide the required TTV (total thickness variation).

During a reclaiming process in order to remove films a chemical stripping is utilized which is very hazardous, and/or lapping processes are used. Both processes remove up to 50 μm of silicon in order to remove 2–5 μm of films. With the use of these processes, the operator does not see the films which are being removed and therefore the layer to be removed is substantially greater than the thickness of the film, so as not to again machine the same. Moreover, SSD is very high. As a result the removed layer of silicon reaches 50 μm.

Magnetic-abrasive machining is known in the art. One of the methods of magnetic-abrasive machining is disclosed in our U.S. Pat. No. 6,146,245. This method however has the disadvantage in that the machining zone is closed due to the fact that two permanent magnets are used which are located at opposite sides of a workpiece, and also there is a weak magnetic field and gradient between the poles, since with such a magnetic field the pressing and retaining forces which act on the grains of the magnetic abrasive powder between two magnets are smaller than in the case of the use of one magnet.

U.S. Pat. No. 5,855,735 discloses a process for recovering substrates. It has the disadvantages of including microfractures in the surface, which require removal of them from the surface. Edge materials are removed by abrasive tape. Wafer thickness reduction during recycling is 30 microns and less per cycle. These processes use chemicals and abrasive slurry, which are environmentally not friendly and require expensive recovery.

U.S. Pat. No. 4,821,466 discloses a method of grinding a workpiece, in which the magnets are located at one side of the workpiece. However, in this case also the machining zone is closed by the workpiece which is held in the device and faces toward the magnets. Abrasive grains are located between the surface to be machined and the magnets. The magnets include a group of magnets placed side by side, in which adjoined poles have different polarity with respect to one another.

U.S. Pat. Nos. 5,449,313; 5,616,066 and 5,577,948 disclose further methods of polishing of an object. In these methods the surface of the workpiece to be machined is also closed by the workpiece which is held in a device and a magnet, despite the fact that the magnets are located at one side of the workpiece.

U.S. Pat. No. 5,419,735 discloses a magnetic barrel finishing machine which has a rotary disc made of a non ferromagnetic material, a plurality of permanent magnets radially mounted and irregularly arranged on the rotary disk, and magnets located at the one side of a part to be machined. The axis of the rotary magnets coincide with the axis of one immovable container. In this reference the plurality of permanent magnets provide magnetic lines of force which acts in a circumferential direction of the rotary disk and in a radial direction of the rotary disk inwardly or outwardly. Such different motions or flows of the work pieces and abrasive media do not provide a mutually perpendicular pattern of scratches. It is also believed that the machine disclosed in this reference does not operate in practice as described, since different polarity of the magnets and their arrangement does not generate an alternating magnetic field that cause the workpieces and the abrasive medium to flow in an irregular fashion in two different groups. In fact, when a mixture of abrasive medium and workpieces is located in the container, a magnetic component of abrasive medium and/or workpieces is pressed to the bottom of the container after the locations where the permanent magnets are arranged. The polarity of the magnets and their arrangement does not influence this. This is done by those elements which can be attracted or pressed to the magnets. A part of them is not pressed directly against the bottom, but is pressed to non magnetic elements which lien the bottom. If the magnetic elements contain a magnetic abrasive, then an abrasive cutting takes place. If they do not contain a magnetic abrasive, or in other words the abrasive component is not magnetic, then the abrasive cutting does not take place since the abrasive elements are rotated together with the non magnetic elements.

It is believed that the magnetic-abrasive machining, in particular of wafers can be further improved.

SUMMARY OF THE INVENTION

It is therefore an object of the present invention to provide a method of and a apparatus for magnetic-abrasive machining whcih avoids the disadvantages of the prior art.

In keeping with these objects and with others which will become apparent hereinafter, one feature of the present invention resides, briefly stated, in a method of and an apparatus for magnetic-abrasive machining of parts, for example wafers, which includes supporting a part, providing a magnetic field by magnetic means located at one side of the part; placing a magnetic-abrasive powder on a surface located at another, opposite side of the part, so that the magnetic-abrasive powder is attracted by said magnetic means and pressed to the surface of the wafer; and providing a relative movement of the part and the magnetic abrasive powder retained by said magnetic means relative to one another so as to machine the surface of the part which is therefore open for observation and supply of the magnetic abrasive powder.

When the method is performed and an apparatus is designed in accordance with the present invention, the surface of the part for example a wafer, which has to be machined, is completely open for observation and supply of the magnetic abrasive powder. Substantially thinner layers can be removed from the wafer so that the wafer can be reclaimed many more times than before. The efficiency of the machining is substantially increased.

In the inventive method and apparatus the parts, for example wafers are rotated around their own axes, while the magnetic means which attract the magnetic-abrasive powder to the wafer from the open side can rotate in any direction, so that the magnetic abrasive powder moves over the surface to be machined as a cutting edge or magnetic means can be immovable and instead the carriers with the wafers can rotate around the axis of the apparatus.

In accordance with the present invention, also the magnetic-abrasive machining is performed so that the carrier is provided with a wall, and during the process the wall moves the powder after the machining atone location, to another location where the thusly moved powder provides a new cycle of machining again.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
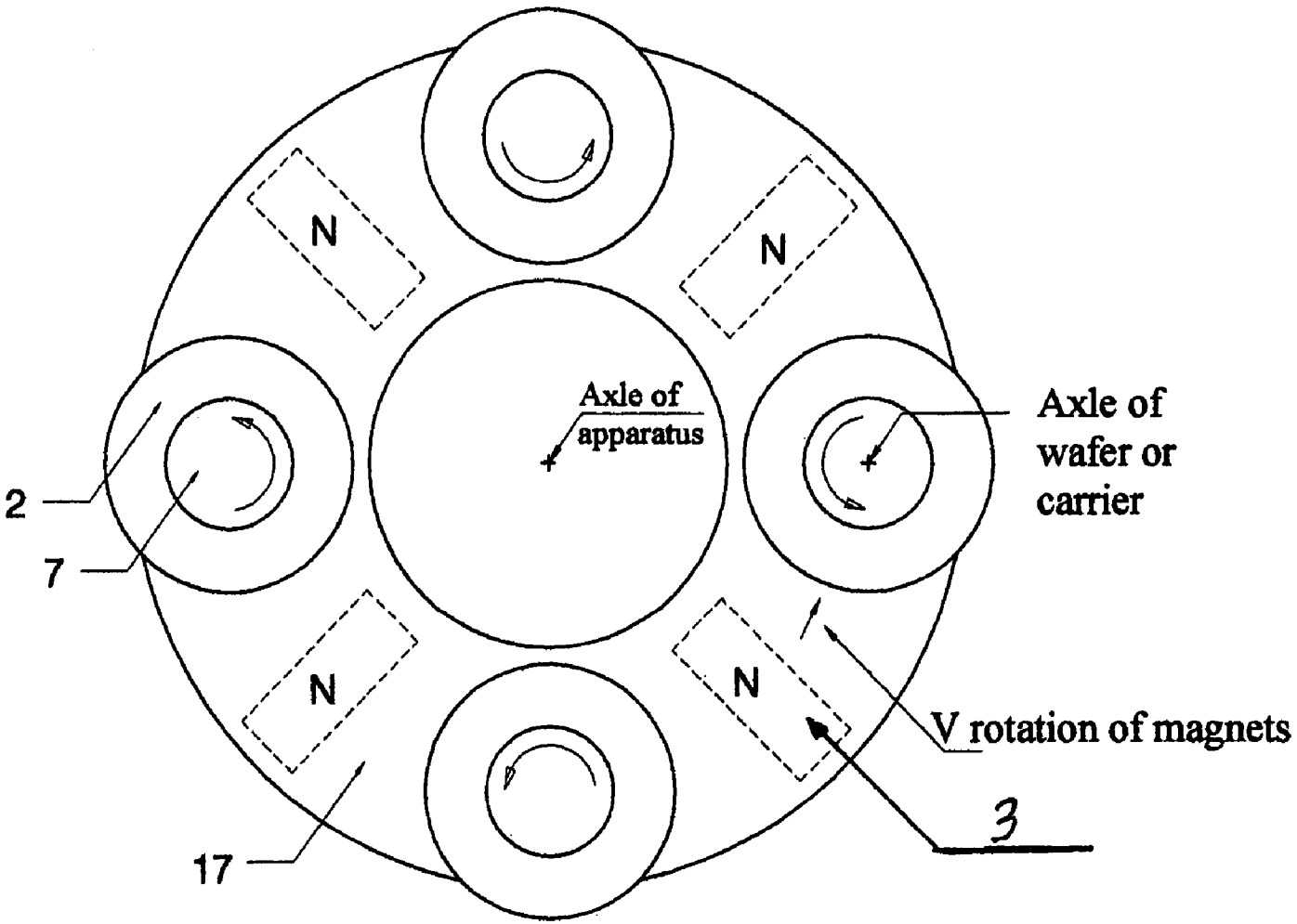
FIG. 1 is a view showing a diagram of apparatus in accordance with the present invention.

A general principle of a method of and apparatus for magnetic-abrasive machining of parts is generally illustrated in FIG. 1. The apparatus has a shaft or an axle. At a certain distance from the shaft, wafers are placed in carriers which rotate around their axes. Magnets, such as electromagnets, permanent magnets, etc. are arranged at equal distances from the shaft or its axis and are fixed on a rotating plate which rotates about an axis of the apparatus. A reverse movement is possible as well.

Every magnet has a linear gradient at its front edge, characterized by the intense magnetic force. The length of linear gradient of one magnet must be greater than the diameter of the wafer, or total length of all gradients must overlap the diameter of the wafers without interruption.

The wafers are arranged in carriers which have walls located around the wafer, preferably over a circle. The magnets are located on the rotating plate at equal angles between the carriers. It is also possible to have one magnet, in which case its linear gradient must be longer than a diameter of a surface to be machined, for example wafer or wafers. A maximum number of magnets corresponds to the number of the carriers. The magnetic-abrasive powder which is located over the wafers in the carriers is attracted to the magnets which are arranged under them.

Figure 2:
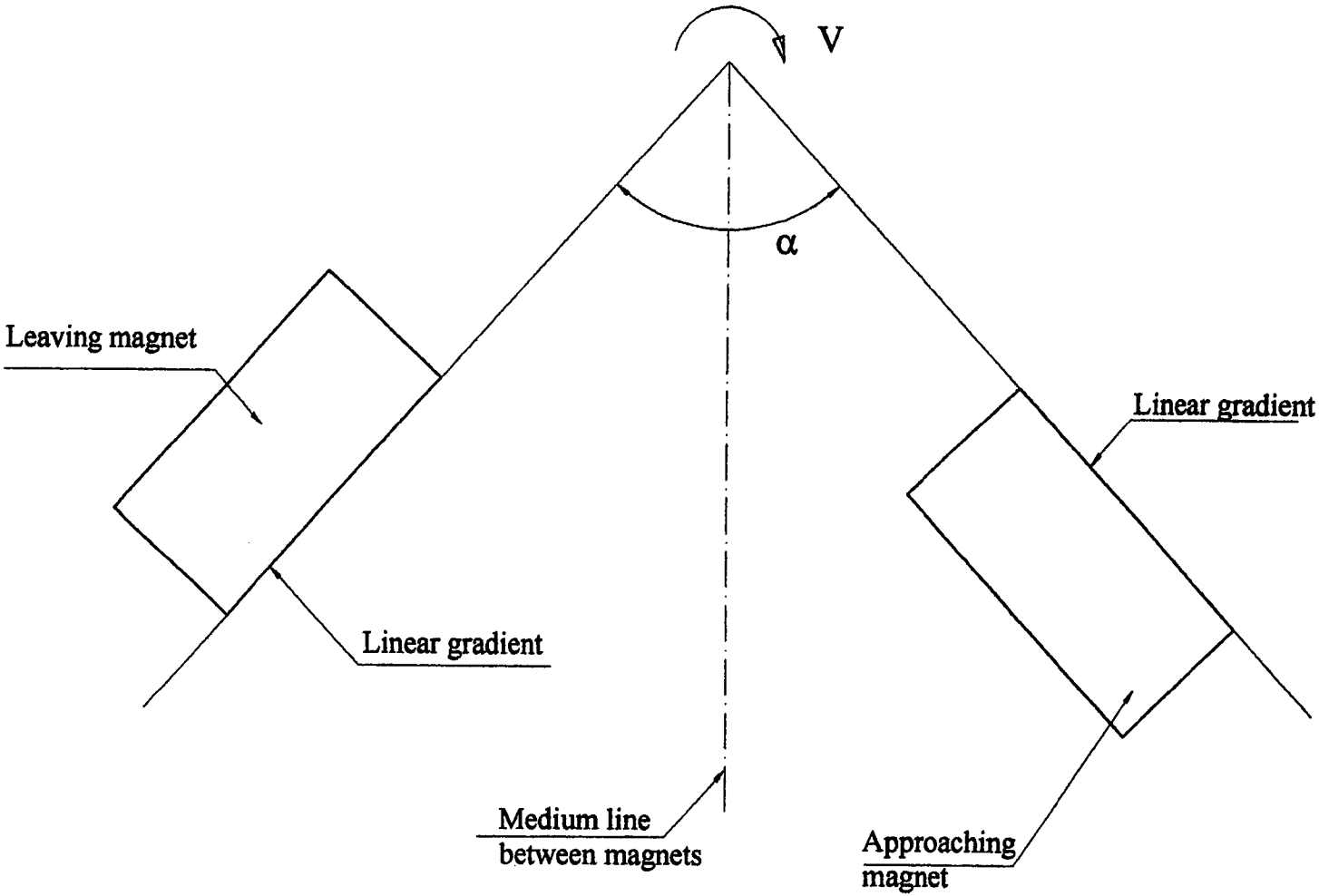
FIG. 2 is a view schematically showing magnets of FIG. 1 and their movement.
Figure 3:
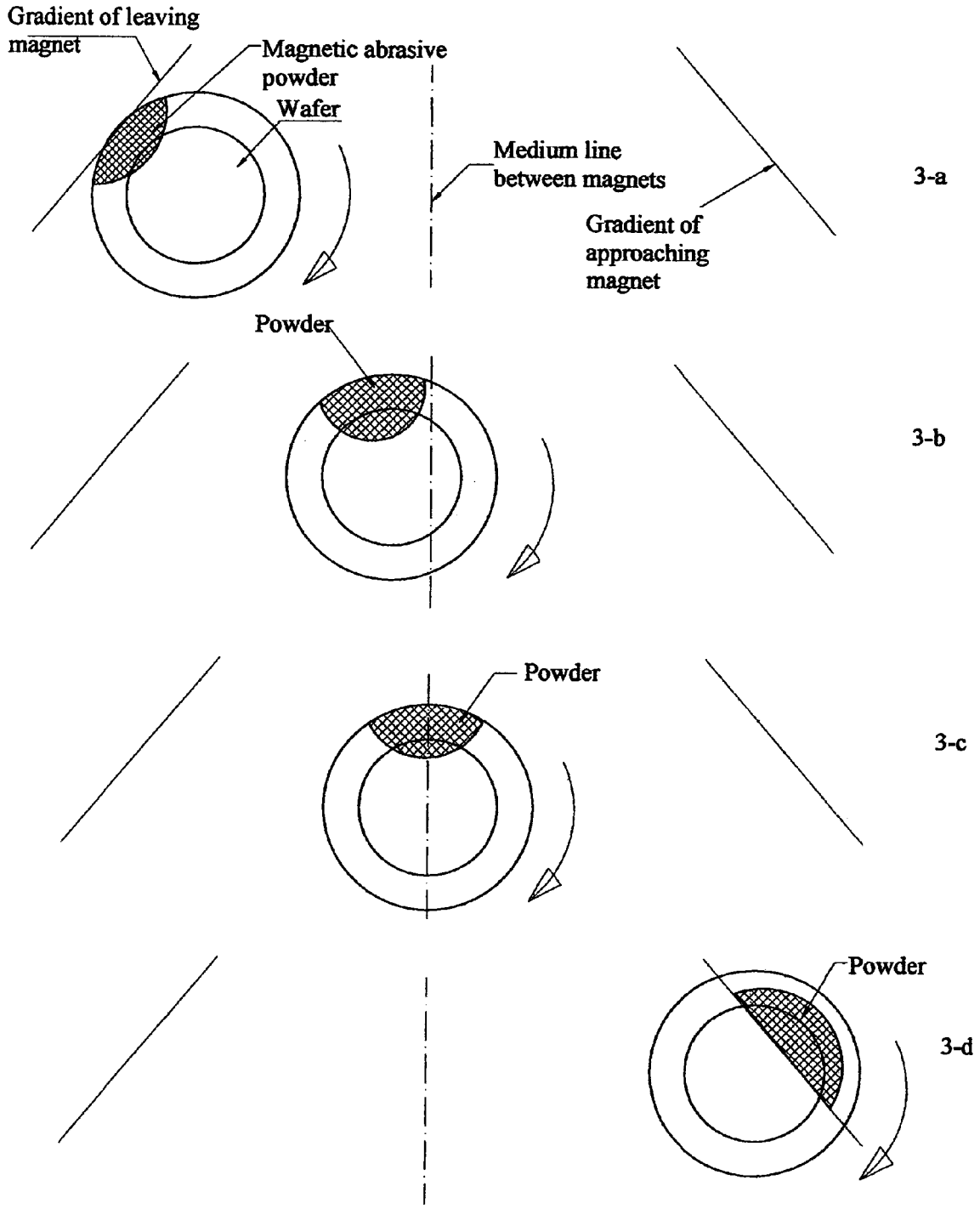
FIGS. 3*a*–3*d* are views showing a movement of a magnetic-abrasive powder in a vacuum carrier for carrying a wafer, during the magnetic-abrasive machining of the wafer.

As shown in FIGS. 2 and 3, one of the magnets which follows the carrier can be identified as a "leaving" magnet, while the other of the magnets which meets the carrier can be identified as "approaching".

The magnetic-abrasive machining of the wafers is performed in the following manner.

The magnetic-abrasive powder 6 which is located in the carriers is attracted to the magnets 3 which are arranged under it. During the rotation of the carriers about their axes and rotation of the magnets about the axis of the apparatus, the wafer is open, in particular its flat surface and its rounding edges are open for machining and for any type of monitoring and control. One of the magnets which leaves the carrier can be identified as "leaving", while the other of the magnets which moves toward the carrier can be identified as "approaching" as shown in FIGS. 3*a* and 3*b*.

The magnetic-abrasive powder moves together with the bottom of the carrier above the approaching magnet until the moment when the magnetic-abrasive powder starts being retained by the approaching magnet. A linear gradient of the magnetic field of the approaching magnet is formed there. When the magnetic-abrasive powder appears in this zone, a "cutter" formed by the magnetic-abrasive powder is produced which is retained by the magnetic gradient. Now when the carrier, the wafer and the plate 9 with the magnets 3 move, the cutter is stationary. A material of the wafer is thereby removed.

A destruction of the cutters starts when the wall 8 of the carrier mechanically removes the magnetic-abrasive powder from the magnetic gradient. The destroyed magnetic-abrasive powder is driven by the wall and moved together with the carrier until it reaches a medium line between the neighboring magnets. This is an imaginary line 3*c*, on which the intensity of the magnetic field is equal to zero. In other words, before the medium line, the magnetic-abrasive powder is still attracted to the leaving magnet, and when each individual grain passes this line, it is already attracted by the approaching magnet. However, since the field of the magnet is uniform, the grains move under the action of the friction force together with the carrier but do not cut the wafers since there is no force which retains the grains since such a force is generated only in the zone of the gradient.

In order to machine the surface of the wafer by the thusly formed cutter, it must be formed outside of the surface of the wafer, or in other words on the bottom of the carrier before the wafer. Therefore the inner diameter of the walls of the carrier must be greater than the diameter of the wafer. In this case the wafer passes under the cutting and is machined. The cutter must be destroyed so as to be formed on the next magnet with the gradient, only when the wafer passes under this cutter.

If it is not desirable that each thusly formed cutter machines the whole wafer, then the ratio can be changed. For example the length of the gradient can be greater than the diameter of the wafer, but formed from the magnets which are located not on the same radius and arranged in a staggered order.

The linear magnetic gradient is provided to create a maximum pressing and retaining force for the magnetic-abrasive powder. The magnetic gradient is formed on the edge of the magnet between the material of the magnet and a surrounding air.

When the magnetic-abrasive powder 6 is in the carrier, it is attracted by the magnetic field and the cutting force is produced. For cutting, a corresponding movement is performed, for example the rotation of wafers around the axis of rotation of the machine and the rotation of the wafers together with the carriers around their own axes, or the rotation of the plate with the magnets around the axis of rotation of the apparatus.

The carriers 2 can have openings which are not shown in the drawings, through which a liquid used for cleaning of wafers from the removed material is drained.

Figure 4:
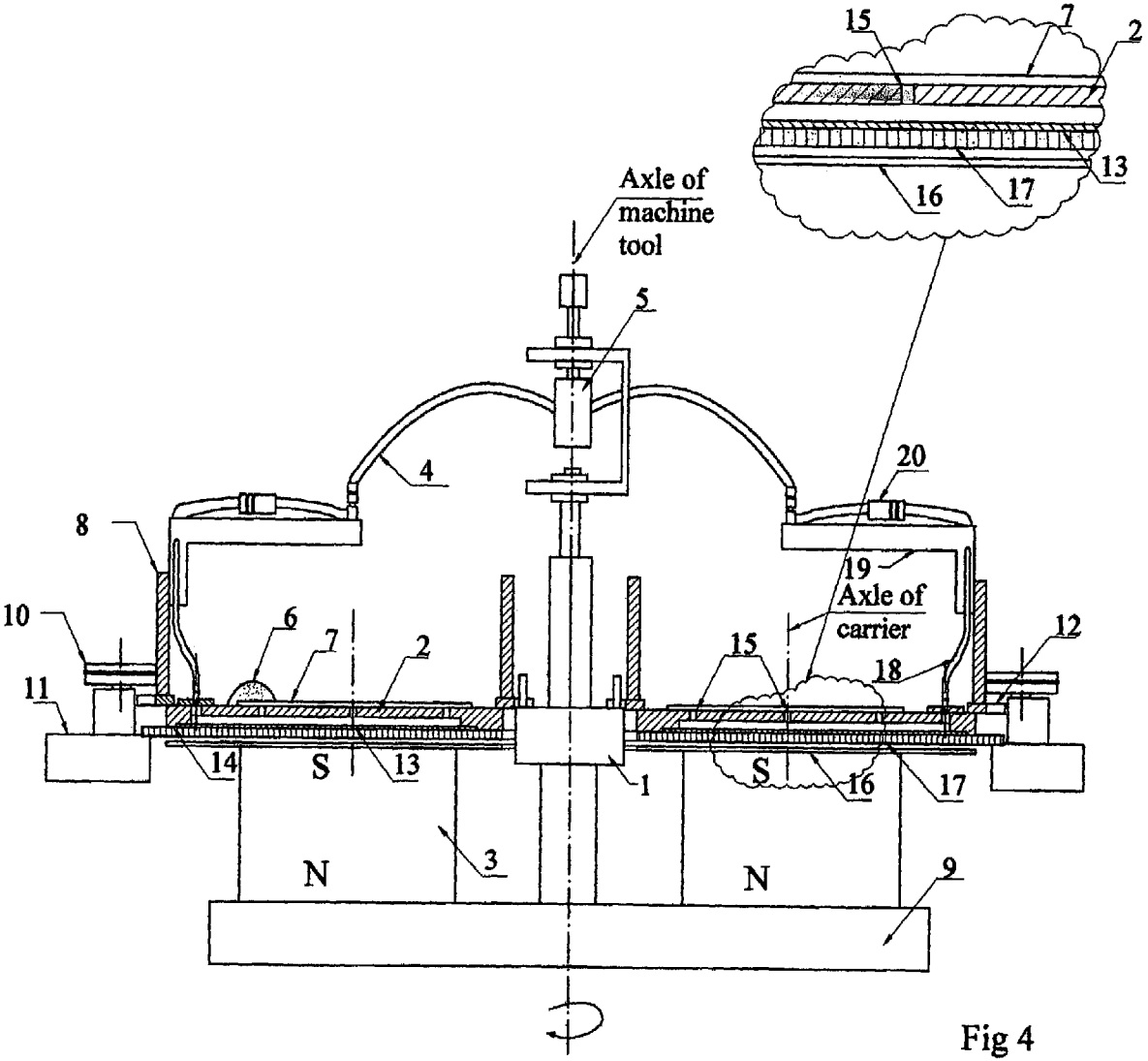
FIG. 4 is a cross-section the apparatus in accordance with the present invention.
Figure 5:
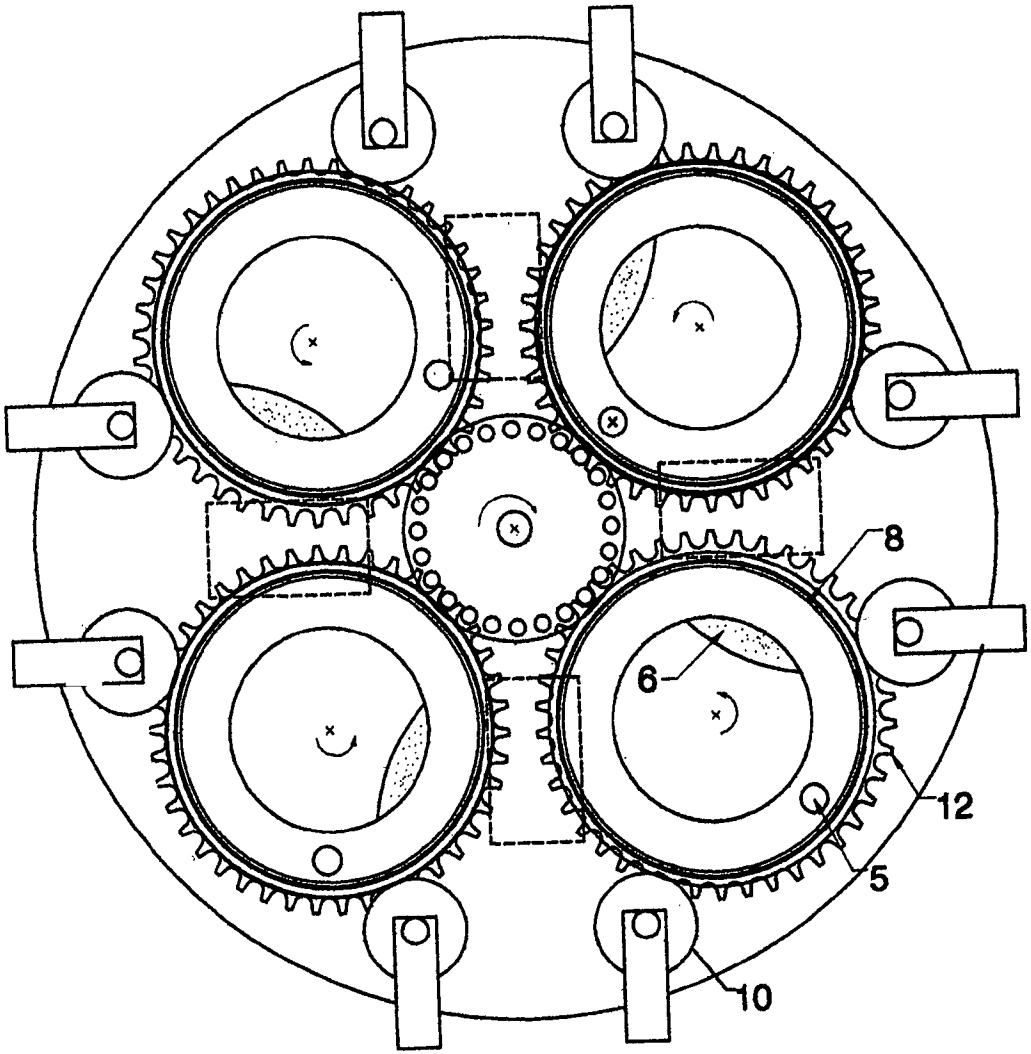
FIG. 5 is a plan view of the apparatus in accordance with the present invention.
Figure 6A:
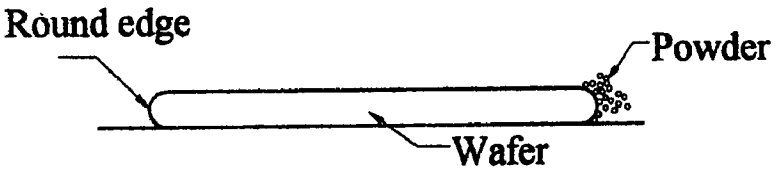
FIG. 6*a* is a view showing machining of round edges simultaneously with a flat surface of wafers.
Figure 6:
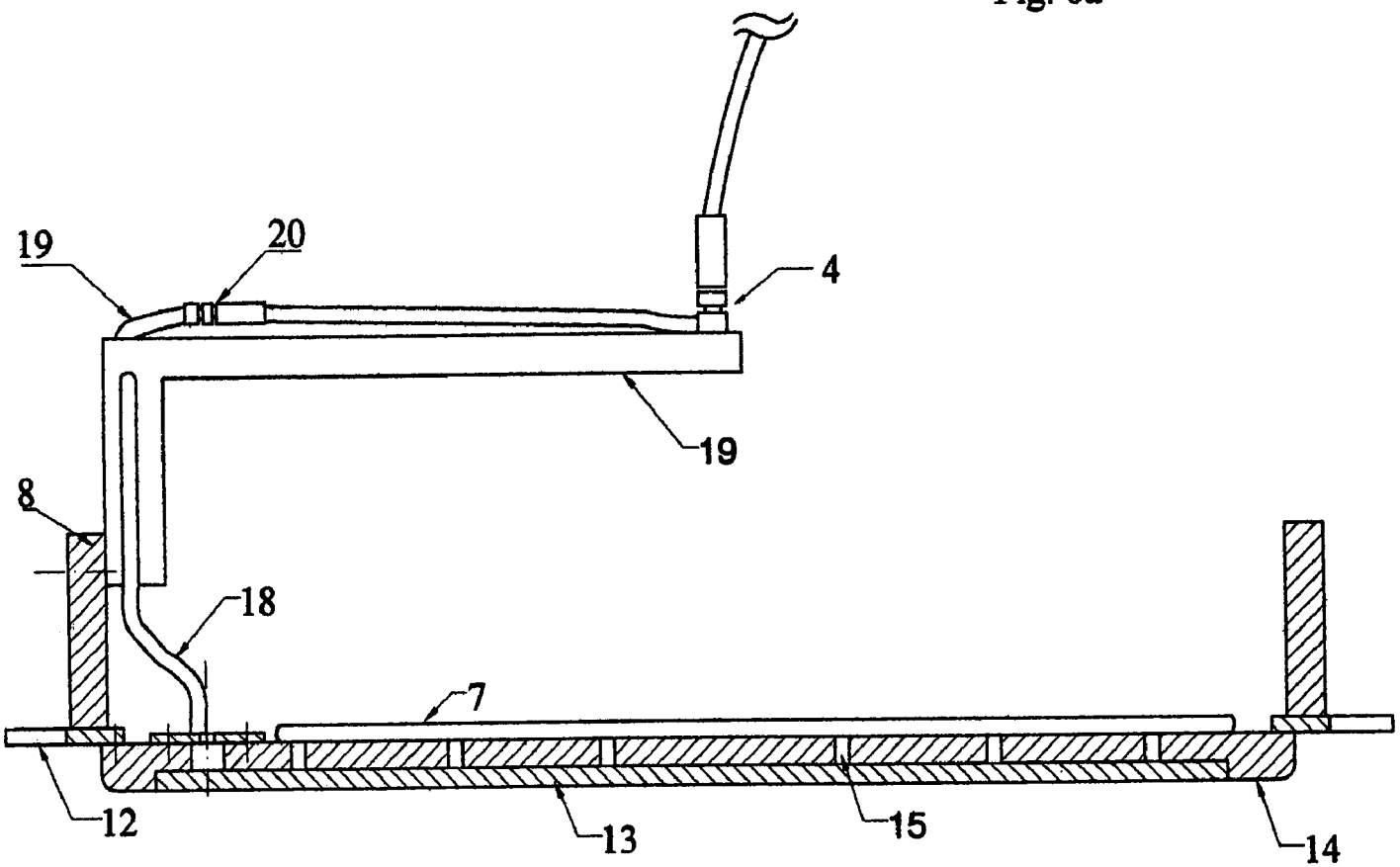
FIG. 6 is a view schematically showing a vacuum carrier which is used in the inventive apparatus.

The apparatus in accordance with the present invention is illustrated in FIGS. 4 and 5. Wafers 7 to be machined perform a rotational movement around their own axes in vacuum carriers 2 having walls 8. For this purpose the apparatus has a gear ring 1 and the vacuum carrier 2 have outer teeth 12 which engage the gear ring 1 rotatable about its own axis. The wafers 7 are placed and held in the vacuum carriers 2. Not shown boxes composed of a non-magnetic material are fixed on a rotating plate 9. Permanent magnets 3 composed, for example, of neodymium are arranged in the boxes which are covered with a thin sheet of a non magnetic material. They are preferably assembled of several individual magnets. The wafers 7 are retained in the carriers 2 under the action of vacuum. The vacuum system for the vacuum carrier includes a rotating vacuum distributor 5 for all carriers 2, a vacuum tubing 18, a swivel elbow 4, an angle part 19 and a quick connector 20.

The carrier 2 has a bottom cover 13 which can have a network of grooves and covers a bottom 14 provided with holes 15 for vacuum. All parts of the carrier are non-magnetic. During the operation, vacuum is created through the vacuum distributor 5, the tubing 18, the swivel elbow 4 between the bottom 14 of the carrier with the holes 15 and the top of the cover 13, so that the wafers 7 are attracted to the holes and retained in the carrier.

All elements of the carrier 2 are located at one side, and in particular at the side of the wafer. The other side or the bottom of the carrier is completely open. This construction of the carrier allows a maximum reduction of the distance been the magnets and the side of the wafer to be machined.

Holding mechanisms 10 mounted on a table 11 keep the rotating carriers 2 in engagement with the ring 1. A stationary thin sheet of the non-magnetic material 17 is arranged under the bottom of the carriers. It is lubricated on both sides, that the bottoms 14 and the covers 16 are worn less.

During the magnetic-abrasive machining the wafers 7 are open. In particular their flat surfaces and their rounding edges are open for machining and for monitoring and control of any type.

In order to remove a material from the wafer or in other words to produce scratches on the wafer with the magnetic-abrasive power, a certain kinematics is utilized. The objective of this kinematics is formation of rectilinear scratches which intersect at a certain angle. It is known that the best quality of a surface to be machined is obtained at the angle of intersection of scratches 90°. This type of net of scratches is obtained due to the rotation of the wafers 7 around their axes and rotation of the magnets 3 fixed on the rotating plate 9 around the axis of the apparatus. The rotation of the plate 9 can be replaced by the rotation of the wafers also around the axis of the apparatus. This can be done for example with a planetary mechanism. The condition for obtaining such a net of scratches is also that the axes of rotation of the wafers are located at a distance (do not coincide with) from the axis of rotation of the device.

With this kinematic the rotation of the magnets or wafers around the axis of the apparatus is a cutting movement. For example, if the wafers do not rotate while the magnets rotate, the scratches extend in a single direction. When the wafers rotate, which is a feeding movement, transverse scratches are formed. An angle of intersection of the scratches and the length of stroke of the magnetic-abrasive grains on the wafers depends on a ratio between the speeds of the magnets around an axis of the apparatus and the speeds of the wafers around their own axes. The length of the stroke of the grains can be different, for example more or less than a diameter or a radius of the wafer.

It will be understood that each of the elements described above, or two or more together, may also find a useful application in other types of methods and apparatuses differing from the types described above.

While the invention has been illustrated and described as embodied in a method of magnetic-abrasive machining of wafers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A method of magnetic-abrasive machining of a flat part, comprising the steps of supporting the flat part so that it has an upper surface and a lower surface; generating a magnetic field by magnetic means located under the lower surface of the flat part; placing a magnetic-abrasive powder on the upper surface, so that the flat part is located between said magnetic means and said magnetic-abrasive powder and the magnetic-abrasive powder is attracted to the upper surface of the flat part by said magnetic means at a side of the lower surface of the flat part; and providing a movement of the flat part and the magnetic-abrasive powder means relative to one another so as to machine the upper surface of the flat part which carries only the magnetic-abrasive powder and is therefore not obstructed but is open for observation and supply of the magnetic-abrasive powder.

2. A method as defined in claim 1, wherein said generating includes producing by the magnetic means a gradient, and arranging the flat part so that the gradient of the magnetic field during the magnetic-abrasive machining extends through the part.

3. A method as defined in claim 1, wherein said supporting includes carrying the flat part in a carrier with a wall such that a diameter of the flat part is substantially smaller than a diameter of the wall.

4. A method as defined in claim 1, wherein said supporting includes providing a carrier with a wall which, after machining one location of the flat part, displaces the magnetic-abrasive powder to another location of the flat part for further machining.

5. A method as defined in claim 3, wherein said providing a relative movement includes rotating the flat part together with the carrier around an axis of a carrier.

6. A method as defined in claim 1, wherein said supporting includes carrying the flat part in a carrier, and retaining the flat part in the carrier by vacuum.

7. A method as defined in claim 1; and further performing the relative movement so that the magnetic-abrasive powder forms a cutter.

8. A method as defined in claim 1; and further comprising forming by the magnetic-abrasive powder a cutter which machines the flat part; said supporting including providing a carrier with a wall which after machining of one location of the flat part destroys the cutter and displaces the magnetic-abrasive powder to another location to form a cutter for machining of another location of the flat part.

9. A method as defined in claim 1, wherein said supporting includes supporting the flat part on a supporting element having an upper surface on which the flat part is supported and the magnetic-abrasive powder is placed, and a lower surface; and arranging said magnetic means under the lower surface of said supporting element.

10. An apparatus for magnetic-abrasive machining of a flat part, comprising means for supporting the flat part so that it has an upper surface and a lower surface; means for generating a magnetic field by magnetic means located under the lower surface of the flat part; means for placing a magnetic-abrasive powder on the upper surface of the flat part, so that the flat part is located between said magnetic means and said magnetic-abrasive powder and the magnetic-abrasive powder is attracted to the upper surface of the flat part by said magnetic means at a side of the lower surface of the flat part; and means for providing a relative movement of the flat part of the magnetic-abrasive powder relative to one another so as to machine the upper surface of the flat part which carries only the magnetic-abrasive powder and is therefore not obstructed but open for observation and supply of the magnetic-abrasive powder.

11. An apparatus as defined in claim 10, wherein said magnetic means is formed so that the magnetic means form a gradient of the magnetic field which during the magnetic-abrasive machining extends through the flat part.

12. An apparatus as defined in claim 10, wherein said supporting means include a carrier with a wall selected so that a diameter of the flat part is substantially smaller than the diameter of said wall.

13. An apparatus as defined in claim 10, wherein said supporting means include a carrier with a wall which, after machining of one location of the flat part, displaces the magnetic-abrasive powder to another location of the flat part for further machining.

14. An apparatus as defined in claim 10, wherein said means for providing a relative movement is formed so as to rotate the flat part around an axis of a carrier in which it is located.

15. An apparatus as defined in claim 10; and further comprising vacuum means which retain the flat part in a carrier in which it is supported.

16. An apparatus as defined in claim 10, wherein said means for providing a relative movement is formed so that the magnetic-abrasive powder forms a cutter.

17. An apparatus as defined in claim 10, wherein said supporting means include a carrier provided with a wall, said generating means being formed so that a cutter is formed by the magnetic-abrasive powder, and said wall being formed so that after machining of one location of the flat part said wall destroys said cutter and displaces the magnetic-abrasive powder to another location to form a cutter for machining another location of the flat part.

18. An apparatus as defined in claim 10, wherein said supporting means have an upper surface on which the flat part is located and the magnetic-abrasive powder is placed, and a lower surface, said magnetic means being located under said lower surface of said supporting means.

* * * * *